US006271191B1

(12) United States Patent
Kerobo et al.

(10) Patent No.: US 6,271,191 B1
(45) Date of Patent: Aug. 7, 2001

(54) HARD SURFACE CLEANER CONTAINING ANIONIC SURFACTANT

(75) Inventors: Charles O. Kerobo, Southfield, MI (US); Richard J. Holland, Flanders, NJ (US); Michael C. Welch, Woodhaven, MI (US); Suzanne M. Gessner, Ypsilanti, MI (US); Sonia J. Patterson, Detroit, MI (US)

(73) Assignee: BASF Corporation, Mount Olive, NJ (US)

( * ) Notice: Subject to any disclaimer, the term of this patent is extended or adjusted under 35 U.S.C. 154(b) by 0 days.

(21) Appl. No.: 09/345,227

(22) Filed: Jun. 30, 1999

(51) Int. Cl.[7] ..... C11D 17/00

(52) U.S. Cl. ..... 510/475; 510/421; 510/476; 510/479; 510/505; 510/506

(58) Field of Search ..... 510/475, 476, 510/479, 505, 506, 421

(56) References Cited

U.S. PATENT DOCUMENTS

| | | | |
|---|---|---|---|
| 4,020,016 | 4/1977 | Sokol . | |
| 4,533,485 | 8/1985 | O'Connor et al. . | |
| 4,827,028 | 5/1989 | Scardera et al. . | |
| 5,252,245 | 10/1993 | Garabedian, Jr. et al. . | |
| 5,382,376 | 1/1995 | Michael et al. . | |
| 5,437,807 | 8/1995 | Garabedian, Jr. et al. . | |
| 5,454,984 | 10/1995 | Graubart et al. . | |
| 5,468,423 | 11/1995 | Garabedian, Jr. et al. . | |
| 5,501,816 | 3/1996 | Burke et al. . | |
| 5,536,452 | 7/1996 | Black . | |
| 5,575,864 | 11/1996 | Haley et al. . | |
| 5,585,342 | 12/1996 | Choy et al. . | |
| 5,587,022 | 12/1996 | Black . | |
| 5,814,591 | 9/1998 | Mills et al. . | |
| 5,853,430 | 12/1998 | Shindo et al. . | |
| 5,854,193 | 12/1998 | Mondin et al. . | |
| 5,912,220 | 6/1999 | Sramek et al. . | |
| 6,017,863 * | 1/2000 | Cala et al. | 510/200 |

OTHER PUBLICATIONS

BASF 1993 Technical Bulletin, "Lime Soap Removal Test Methods and Results."

OLIN 1996 Technical Product Information, "Surfactants Application Data," "Poly–Tergent® LS–1 Sequestering Properties."

* cited by examiner

*Primary Examiner*—Necholus Ogden
(74) *Attorney, Agent, or Firm*—David T. Banchik

(57) ABSTRACT

There is provided a hard surface cleaning composition comprising:

(a) a water soluble organic solvent;

(b) an anionic surfactant which comprises the reaction product of maleic acid, fumaric acid, itaconic acid, or a mixture thereof and at least one selected poly (oxyalkylated) polyol or epoxy-capped poly (oxyalkylated) polyol in the presence of a peroxy-type free radical initiator to form a carboxylic group containing addition product,; and (c) a third component comprising a chelating agent or a nonionic surfactant selected from the group consisting of alcohol alkoxylates, alcohol block alkoxylates, polyoxyethylene polyoxypropylene block surfactants, and mixtures thereof.

18 Claims, No Drawings

HARD SURFACE CLEANER CONTAINING ANIONIC SURFACTANT

FIELD OF THE INVENTION

The invention relates to a hard surface cleaner containing an anionic surfactant, and especially to a cleaner effective at removing soap scum and other deposits without wiping or scrubbing.

It is desirable that a hard surface cleaner for cleaning bathtub, shower, and bathroom surfaces be effective at removing soap scum and other deposits. The cleaner should readily remove the deposits, and leave the cleaned surfaces streak free. It is further desirable that the cleaner work with a minimum of wiping and scrubbing by the person cleaning the surface.

It is further desirable that the cleaner should be effective on a variety of materials which are found in bathrooms, such as porcelain, glass, and various plastics such as polyvinyl chloride as found in shower curtains, or styrenics as might be found in shower liners.

Applicants have surprisingly found that a class of anionic surfactants not heretofore known or suggested for use in this art is useful for accomplishing the above desirable goals.

BACKGROUND OF THE INVENTION

Mills, U.S. Pat. No. 5,814,591, provides aqueous hard surface cleaners with nonionic surfactants, ammonium EDTA, and an organic solvent.

Choy, U.S. Pat. No. 5,585,342 provides an aqueous hard surface cleaner containing solvent and a semipolar nonionic surfactant, buffered to a pH greater than 6.5.

Graubart, U.S. Pat. No. 5,454,984, provides a cleaning composition containing a quaternary ammonium compound component, a nonionic surfactant, and a glycol ether component, with optional chelators.

Sokol, U.S. Pat. No. 4,020,016, provides aqueous cleaning compositions containing one or more nonionic surfactants, nitrogen containing salts of nitrilotriacetic acid or an alkylene polyamine polycarboxylic acid, and water, wherein the composition is substantially free of sodium ions.

Garabedian, U.S. Pat. No. 5,252,245 and U.S. Pat. No. 5,437,807, provides an aqueous hard surface cleaner containing an alkanol or alkylene glycol ether, a surfactant selected from amphoteric, nonionic, and anionic surfactants or mixtures thereof; and an effective amount of a nitrogenous buffer. To avoid streaking, sodium ions are avoided and the amount of surfactant is kept to a minimum.

Garabedian, U.S. Pat. No. 5,468,423, provides an aqueous hard surface cleaner containing an alkanol or alkylene glycol ether, a nonionic surfactant, and an effective amount of a nitrogenous buffer.

Black, U.S. Pat. No. 5,536,452 and U.S. Pat. No. 5,587,022, provides an aqueous rinsing solution composition and a method of use of the same without scrubbing or wiping, wherein the composition contains a nonionic surfactant having an HLB of 13 or less, a chelating agent, and optionally an alcohol and/or ammonium hydroxide and/or morpholine.

SUMMARY OF THE INVENTION

There is provided according to the invention a novel hard surface cleaning composition comprising a) a water soluble organic solvent b) an anionic surfactant which comprises the reaction product of maleic acid, fumaric acid, itaconic acid, or a mixture thereof with at least one poly(oxyalkylated) polyol or epoxy-capped poly(oxyalkylated) polyol in the presence of a peroxy-type free radical initiator to form a carboxylic group containing addition product, wherein the reaction product is neutralized with a sufficient amount of a neutralizing agent to convert at least a major portion of carboxylic groups in the reaction product to salt groups; and c) optionally, a third component which is either a chelating agent or alternatively a nonionic surfactant selected from the group consisting of alcohol alkoxylates, alcohol block alkoxylates, polyoxyethylene polyoxypropylene block surfactants, and mixtures thereof.

In one embodiment, the invention is a straight blend of the components above. In another embodiment, the invention is a concentrated aqueous solution of the above components, ready for dilution with water as needed to the end use concentration. In yet another embodiment, the invention is an aqueous solution of the above components, diluted to the end use concentration for direct use by the ultimate consumer.

DETAILED DESCRIPTION OF A PREFERRED EMBODIMENT OF THE INVENTION

The compositions of the invention are useful as aqueous hard surface cleaners, and are especially suited to cleaning vertical surfaces having thereon soap scum and similar debris, with a minimum of wiping and scrubbing. As such, the compositions are intended to be applied to the vertical surfaces by spraying from a pump sprayer bottle, aerosol can, or other delivery system onto the vertical surface, and allowing the compositions to drain away and/or evaporate from the surface, leaving the surface clean and streak-free. It is acknowledged that originally the surface may be so soiled with soap scum and related debris that the user may need to do some scrubbing to remove the soil, but thereafter the compositions are designed so as to minimize the amount of wiping and scrubbing when applied daily or after each shower. It is therefore contemplated that the compositions of the invention will advantageously be used to clean shower surfaces on a daily basis, or after each shower.

As such, the compositions of the invention all perform satisfactorily in a soak test, described below, which measures the ability of the compositions to clean a surface without wiping or scrubbing. The performance of the compositions of the invention is comparable to or exceeds the performance of commercially successful cleaning compositions, as shown in the Examples. Preferred compositions perform well in a series of streak tests on different materials to be found in a shower or bath environment.

The compositions of the invention are useful as component blends such as would be made for shipping to a bottler or packager for further processing to make the compositions ultimately used by the consumer. The invention also covers concentrated aqueous solutions of the components, such as might be shipped from a blending facility to another location for further dilution to the end concentrations to be used by the consumer. The compositions of the invention are also useful when diluted with water to the final use concentrations discussed below.

Compositions of the present invention comprise a water soluble organic solvent, an anionic surfactant, and, optionally, a third component comprising a chelating agent or nonionic surfactant. Optional ingredients may be added to the novel compositions of the invention, without departing from the intended scope. Such optional ingredients are well known to those of skill in the art, and include but are not limited to colorants, fragrances, preservatives, buffering agents, thickeners, and antibacterial agents.

A detailed description of the components of the invention is as follows:

A. The Water Soluble Organic Solvent

The organic solvent useful in the invention enhances the cleaning performance by causing the compositions to rinse better or to drain more readily from vertical surfaces. The solvent can also increase the evaporation rate of the cleaning composition, which reduces streaking and leads to a glossier looking surface. Thus the organic solvent is to be chosen based on its solubility in water, and its having sufficient volatility to perform well in cleaning. Further, it is naturally desirable that the solvent be non-toxic and have a non-offensive odor. Useful solvents are described in U.S. Pat. No. 5,814,591 and U.S. Pat. No. 5,585,342, the descriptions of which are hereby incorporated by reference.

Within the above parameters, a wide range of solvents is useful. Typical, but non-limiting examples are selected from $C_{1-6}$ alkanol, $C_{1-6}$ diols, $C_{3-24}$ alkylene glycol ethers, and mixtures thereof. The alkanol can be selected from methanol, ethanol, n-propanol, isopropanol, butanol, pentanol, hexanol, their various positional isomers, and mixtures of the foregoing It may also be possible to utilize in addition to, or in place of, said alkanols, the diols such as methylene, ethylene, propylene and butylene glycols, and mixtures thereof. Other suitable solvents include acetone, butanone, N-methylpyrrolidone, alkyl ethers of alkylene glycols, alkanolamines, N-alkyl alkanolamines, low molecular weight ketones, and water soluble alkyl pyrrolidones. It is preferred to use an alkylene glycol ether solvent in this invention. The alkylene glycol ether solvents can include ethylene glycol monobutyl ether, ethylene glycol monopropyl ether, propylene glycol n-propyl ether, propylene glycol monobutyl ether, dipropylene glycol methyl ether and mixture s thereof Preferred glycol ethers are ethylene glycol monobutyl ether, also known as butoxyethanol, sold as buty Cellosolve by Union Carbide, and also sold by Dow Chemical Co., 2-(2-butoxyethoxy) ethaol sold as butyl Carbitol, also by Union Carbide, and propylene glycol n-propyl ether, available from a variety of sources. Another preferred alkylene glycol ether is propylene glycol t-butyl ether, which is commercially sold as Arcosolve PTB, by Arco Chemical Co. The n-butyl ether of propylene glycol is also preferred.

Examples of less desirable solvents are methanol because of its toxicity, and water-soluble carboxylic acids such as acetic acid and butyric acid as well as water-soluble organic amines because of their objectionable odor. Some solvents may be so volatile that their use is less preferred. An example in the latter category is acetone.

Two solvents preferred for their blend of desirable properties such as commercial availability, low toxicity, no objectionable odor, and good performance in cleaning are isopropyl alcohol and the monobutyl ether of ethylene glycol.

B. The Anionic Surfactant

The anionic surfactants useful in the invention comprise the reaction product of maleic acid, fumaric acid, itaconic acid, or a mixture thereof with at least one poly (oxyalkylated) polyol or epoxy-capped poly(oxyalkylated) polyol in the presence of a peroxy-type free radical initiator to form a carboxylic group-containing addition product, wherein the reaction product is neutralized with a sufficient amount of a neutralizing agent to convert at least a portion of carboxylic groups in the reaction product to salt groups. Useful surfactants and a method for their preparation are described in U.S. Pat. No. 4,827,028 and U.S. Pat. No. 4,533,485, the disclosures of which are hereby incorporated by reference. Suitable anionic surfactants useful in the invention are available commercially from BASF Corporation under the POLY-TERGENT® line of surfactants.

A suitable neutralizing agent is sodium hydroxide. When sodium hydroxide is used to neutralize the reaction product, the anionic surfactant will contain sodium ions and carboxylate anions.

A preferred anionic surfactant according to the present invention is one incorporating a polyol which is a block copolymer of ethylene oxide and propylene oxide. Such block copolymers are made by methods known to those of skill in the art. In general, they are made by charging an initiator molecule and a catalyst to a reaction vessel. An alkylene oxide comprising ethylene oxide, propylene oxide, butylene oxide, or a mixture thereof is then polymerized onto the initiator molecule to form a first alkylene oxide block. Thereafter, ethylene oxide, propylene oxide, butylene oxide, or a mixture thereof is polymerized onto the first block to form a second alkylene oxide block, with the proviso that the relative oxide composition of the second block is different from that of the first block. Optionally thereafter, third and subsequent alkylene oxide blocks may be added, with the proviso that adjacent alkylene oxide blocks have different relative oxide compositions.

The initiator molecule can be any compound containing one or more functional groups, such as hydroxyl, amine, amide, or carboxyl, which will react with an alkylene oxide. Surfactants of two, three, four, or more blocks can readily be made. The relative oxide composition of the blocks can be varied, as described above.

A preferred anionic surfactant is made from a polyol where the initiator molecule is a monoalcohol with 6 to 18 carbon atoms, and the polyol has three alkylene oxide blocks, of which the first block consists essentially of propylene oxide, the second consists essentially of ethylene oxide, and the third block consists essentially of propylene oxide. Such a polyol is called a triblock copolymer of propylene oxide, ethylene oxide, and propylene oxide, and can be represented as $$R—(PO)_a—(eo)_b—(po)_c—OH$$

where eo represents an ethylene oxide unit; po represents a propylene oxide unit; a, b, and c represent on average the number of ethylene oxide or propylene oxide units in each of the blocks; and R represents an alkyl group with 6 to 18 carbon atoms. As is conventional in the art and well known to those who practice it, the formula above is a shorthand representation indicating that the polyol is made by using an alcohol R—OH as an initiator molecule and first polymerizing units of propylene oxide equivalent to onto the alcohol to form the first alkylene oxide block, followed by polymerizing units of ethylene oxide equivalent to b to form the second alkylene oxide block, and then polymerizing units of propylene oxide equivalent to c to form the third alkylene oxide block.

In the formula above preferably a is from 1 to 5, b is from 8 to 20, and c is from 5 to 40. More preferably, a is about 3, b is from 10 to 20, and c is from 8 to 30. Most preferably, a is about 3, b is about 14, and c is about 17, and R is an alkyl group having from 6 to 10 carbon atoms.

C. Third Component

Useful chelating agents are those which have two or more carboxyl groups and which are effective at chelating metal ions, especially hard water ions such as calcium and magnesium. Many such chelating agents are described in *McCutcheon's Volume 2: Functional Materials North American Edition* (1998), pages 35–42, the disclosure of which is herein incorporated by reference.

Examples of suitable chelating agents include gluconic acid, N-hydroxyethylethylenediamine triacetic acid, diethylenetriamnine pentaacetic acid, nitrilotriacetic acid, ethylenediamine tetraacetic acid, N-hydroxyethylaminodiacetic acid, methylglycinediacetic acid, and salts thereof. Mixtures of chelating agents are also useful.

The salts can be any water-soluble salt, such as sodium, ammonium, calcium, potassium, ferric, alkylamine, or hydroxyalkylamine. The sodium salts of these chelating agents are in general readily available, and are likely to be the least expensive; for both of these reasons, the sodium salt is preferred. However it is expected that any of the salts will perform well in the invention.

One of the most commonly used chelating agents is ethylenediamine tetraacetic acid (EDTA) and its salts. Another chelating agent, which is useful for its performance as a chelator and for its desirable property of being biodegradable, is methylglycine diacetic acid (MGDA) and its salts.

The third component of the present invention may alternatively be a nonionic surfactant. Useful hard surface cleaners can be made which contain no chelating agent when a nonionic surfactant is used in conjunction with the anionic surfactant and the organic solvent of the present invention. The nonionic surfactant is preferably either an alcohol alkoxylate, an alcohol block alkoxylate, a polyoxyethylene polyoxypropylene block surfactant, or a mixture thereof.

The alcohol alkoxylates are made by using an alcohol as an initiator molecule, and adding an alkylene oxide or a mixture of alkylene oxides to form a first block. Thereafter, a second alkylene oxide or mixture of alkylene oxides can optionally be added to form a second block. Third and subsequent blocks can also be added. Generally, the only proviso is that adjacent blocks have different relative alkylene oxide compositions.

Alcohol alkoxylates are commercially available, for example as the Plurafac® surfactants of BASF Corporation. One example is surfactants represented by the general formula $$R—(\text{oxidel})_a—OR'$$

where R is the alkyl residue of an alcohol which has 6 to 24 carbon atoms; a represents the average number of units of alkylene oxide; oxidel is an alkylene oxide selected from the group consisting of ethylene oxide, propylene oxide, butylene oxide, and a mixture thereof; and where R' is hydrogen, an alkyl group with 1 to 18 carbon atoms, a hydroxyalkyl group, or a mixture thereof. As used herein, butylene oxide refers to any of 1,2-butylene oxide, 2,3-butylene oxide, and isobutylene oxide, and to mixtures of them. These surfactants are made by adding the alkylene oxide or mixture of alkylene oxides to an alcohol R—OH. Useful surfactants are obtained when a is less than or equal to about 30. It is more preferable that a be less than about 20. The oxidel is preferably a heteric blend of ethylene oxide and propylene oxide, with ethylene oxide being present at greater than 50%, preferably at greater than 70% of the total number of the a units of alkylene oxide. The R group preferably contains from about 8 carbons to about 16 carbons, and more preferably from about 10 to about 16 carbons. A preferred surfactant is one where R contains 10 to 12 carbon atoms, R' is hydrogen and a is about 1 5, where of the 15 units of alkylene oxide, about 13 are ethylene oxide and about 2 are propylene oxide.

Also useful are the diblock and the triblock alcohol alkoxylates. The diblock alcohol alkoxylate can be represented as $$R—(\text{oxidel})_a—(\text{oxide2})_b—OR'$$

while the triblock alcohol alkoxylate can be represented as $$R—(\text{oxidel})_a—(\text{oxide2})_b—(\text{oxide3})_c—OR'$$

where R is an alkyl or aralkyl group containing 6 to 24 carbon atoms; oxidel, oxide2, and oxide3 each represent an alkylene oxide selected from the group consisting of ethylene oxide, propylene oxide, butylene oxide, and a mixture thereof, with the proviso that the relative alkylene oxide composition of oxide2 differs from that of oxidel and oxide3; a, b, and c are each from about 1 to about 35; and R' is hydrogen, an alkyl group with 1 to 18 carbon atoms, a hydroxyalkyl group, or a mixture thereof.

Examples of useful alcohol block alkoxylates are the diblock alkoxylates where the blocks are essentially all ethylene oxide or essentially all propylene oxide. These can be represented by the general formulas $$R—(eo)_a—(po)_b—OR'$$

or $$R—(po)_a—(eo)_b—OR'$$

where R is the alkyl or aralkyl residue of an alcohol containing 6 to 24 carbon atoms; a and b are each from 1 to about 30; eo represents an ethylene oxide unit; po represents a propylene oxide unit; and R' is hydrogen, an alkyl group with 1 to 18 carbon atoms, a hydroxyalkyl group, or a mixture thereof.

A class of polyoxyethylene polyoxypropylene block surfactants useful in the invention is the triblock surfactants represented by the general formula $$R—(eo)_a—(po)_b—(eo)_c—R'$$

where a, b, and c each represent the number of ethylene oxide or propylene oxide units in each of the blocks, and where R and R' are independently H, $C_{1-18}$ alkyl, $C_{1-18}$ hydroxyalkyl, or mixtures thereof. Members of this class of surfactants are commercially available as the Pluronic® surfactants of BASF Corporation.

When such a triblock surfactant is subjected to further reaction with propylene oxide so that polyoxypropylene groups are added to the ends of the triblock surfactant, there is obtained another useful polyoxyethylene polyoxypropylene block surfactant, which can be represented in a similar fashion as $$R—(po)_a—(eo)_b—(po)_c—(eo)_d—(po)_e—R'$$

where a, b, c, d, and e each represent the number of ethylene oxide or a propylene oxide units in each of the blocks, and where R and R' are independently H, $C_{1-18}$ alkyl, $C_{1-18}$ hydroxyalkyl, or mixtures thereof.

Preferred polyoxyethylene polyoxypropylene block surfactants have a molecular weight of from about 1800 to about 6000, more preferably from about 2000 to about 4000. The block surfactants are preferably comprised of about 20% to about 60% by weight of polyoxyethylene blocks, and more preferably from about 25% to about 50%. A preferred block surfactant is a five block polyoxyethylene polyoxypropylene surfactant having a molecular weight of about 3200, and wherein the polyoxyethylene blocks comprise about 34% of the total weight.

To make the compositions of the invention, the ingredients above are combined together by means well known in the art. The relative levels of the ingredients are selected to give the required performance of the composition in a hard surface cleaning application, with an eye toward making sure on the one hand that a component is present at a sufficient level to be effective, but on the other hand that excessive cost is avoided by limiting the upper range of the component.

Given the above considerations, the organic solvent (a) is advantageously used at a level of from about 0.1 to about 10 parts by weight; the anionic surfactant (b) is generally useful at levels from about 0.5 to about 10 parts by weight; and the third component, which is either a chelating agent or a nonionic surfactant, can be used at levels from about 0.2 to about 10 parts by weight.

By combining the ingredients at the above levels, one obtains useful hard surface cleaning compositions especially suited to be diluted with water and used to clean bathroom and other surfaces of soap scum and other deposits with a minimum of wiping and scrubbing.

As noted above, another object of the invention is to provide aqueous concentrates of the components of the invention. To this end, water is added to the blend of three components, which components are present in the ranges of parts by weight given above. Water can be added up to an amount where the percentage by weight composition of components (a), (b), and (c) in the water containing composition is numerically equal to the parts by weight of the components given above. Another way of saying this is to note that water can be added to a blend comprising components (a), (b), and (c) up to an amount where the sum of the concentrations of all the components, including the water, adds up to 100 parts by weight. It is readily seen then that the parts by weight given above for the components (a), (b), and (c) are numerically equal to the percent by weight composition in the aqueous composition.

For many reasons, it may be desirable to add water to components (a), (b), and (c), but to add less water than would be needed to dilute the components to their final end use concentration. For example, it may be desirable to add half the water or less so as to make a cleaning concentrate that can be shipped to a customer for further dilution with water and bottling or packaging for the consumer. Thus the invention covers concentrates comprising components (a), (b), (c), and water.

The preferred compositions to be discussed below refer to percents by weight in the final aqueous solution to be used by the consumer. Based on the discussion above, they refer equally to the parts by weight of the components in the three component blend.

The water-soluble organic solvent (a) can be used at any effective level. Preferably the level will be from about 0.1% to about 10%. The upper level is somewhat arbitrary, but as a practical matter, the amount of solvent should be limited based on cost and volatility considerations. More preferably, the solvent is present at a level from about 1% to about 8%, and most preferably from about 2% to about 6%. As shown in the examples, a level of 4.4% gives very satisfactory results.

The anionic surfactant (b) is preferably present at levels from about 0.5% to about 10%. Higher levels would probably be effective in performance, but would be less desirable because of cost considerations.

Where the third component (c) is a chelating agent, the anionic surfactant (b) is more preferably from about 1% to about 5% of the composition by weight. Most preferably, it is present at from about 1.5% to about 3%.

Where the third component (c) is a nonionic surfactant, the anionic surfactant (b) is preferably at from 2% to 10%, and more preferably from 3% to 10%.

The chelating agent is preferably present at a level from about 0.2% to about 10%, more preferably from about 0.2% to about 5%, and most preferably from about 0.4% to about 3% by weight.

The nonionic surfactant is preferably at a level of 0.2% to 10%, and more preferably from 0.4% to 3%.

The compositions of the invention may optionally contain additional ingredients that are conventional additives found in cleaning compositions. Such ingredients may include fragrances, dyes, thickeners, and preservatives. Furthermore, the compositions of the invention may be adjusted with mineral acids or organic acids to attain a desired pH, or they may contain buffering systems to hold the pH steady at a desired level.

EXAMPLES

A parent soil recipe is first made with the following ingredients

| | |
|---|---|
| Ivory ® bar soap | 3.90% by weight |
| Shampoo (a) | 0.35 |
| Clay soil (b) | 0.06 |
| Artificial sebum (c) | 0.15 |
| Hard water (d) | 95.54 |

(Ivory ® is a registered trademark of Procter & Gamble Co.)

Notes:

(a) A simple, moderate-cleaning commercial shampoo containing alkyl ethoxysulfates is recommended. A suitable shampoo is Johnson & Johnson's Baby Shampoo, which can be purchased at retail stores. Shampoos containing conditioning or treatment additives should be avoided.

(b) Ball or bandy black clay supplied by H.C. Spinks Co., Paris TN.

(c) Spangler, et al., "A Laboratory Method for Testing Laundry Products for Detergency," JAOCS, Vol. 42, August 1965, pp. 723–727.

(d) 20,000 ppm, 2:1 calcium:magnesium, as $CaCO_3$, using calcium chloride dihydrate and magnesium chloride hexahydrate.

Procedure a) Soil preparation

1. Shave bar soap and place in suitable beaker.
2. Add the remainder of the components, in order, and stir with a three-blade propeller mixer.
3. Warm the entire mixture to 45–50 C.
4. Mix until a smooth suspension is achieved.
5. Filter the suspension through a Buchner funnel fitted with Whatman #1 filter paper.
6. Resuspend the entire filtrate soil in deionized water using the same volume of water that was used to make the soil.
7. Dry the filtrate cake overnight in a 45° C. oven.
8. Pulverize the dry cake and keep in a closed container away from ambient moisture. This is the parent soil Next, a reconstituted soil is made from the parent soil.

| | |
|---|---|
| Parent soil | 4.50% by weight |
| Hard water (as above) | 9.00 |
| HCl (37%) | 0.77 |
| acetone | 85.73 |

1. Combine the above ingredients.
2. Homogenize the suspension until its color turns from white to gray.

b) Soak test

First, ceramic tiles are prepared by washing, drying, and cooling at room temperature; airbrushing 0.1–0.15 g of reconstituted soil onto the tiles; baking at approximately 320° C. for 2 minutes; and cooling overnight at room temperature.

To perform the soak test, the tiles prepared as in the preceding paragraph are soaked in the test formula for 5 minutes, and the percent clean is evaluated qualitatively.

c) Glass and Vinyl Cleaning

To run this test, the reconstituted soil is sprayed onto a vertical 3 inch by 8-inch piece of glass or vinyl shower curtain material. The test piece is allowed to dry for 24 hours in a vertical position, and is evaluated qualitatively according to the scale below. The test is repeated for 5 days, and the rating after the fifth day is reported. The qualitative test scale is

| | |
|---|---|
| 1 | very streaky; tracks from build-up |
| 2 | some streaks; light build-up |
| 3 | even distribution of a thick film |
| 4 | even distribution of a light film |
| 5 | even distribution with semi-gloss |

The higher the numeric value of the qualitative test rating, the more desirable is the result.

Results a) Soak test

Comparative Examples 1, 2, and 3 show the performance in the soak test and in the glass and vinyl cleaning tests of three formulations currently in commercial use. The formulations of the Comparative Examples were obtained by purchase from a local retail store.

Examples 1–3 and 6–12 are within the current invention. It can be seen from Examples 1–3 and Examples 6–12 that the compositions of the invention give performance that is comparable to or exceeds that of commercially successful products.

Examples 4 and 5 illustrate the poor results obtained in the soak test when only two of the required components of the invention are used. The resulting zero % clean in the soak test is considered to be unacceptable in such a cleaning composition.

The other Examples illustrate the dramatic improvements obtained by adding either a chelating agent (Examples 6–12) or a nonionic surfactant (Examples 1–3).

While the Examples show compositions that give a 100% clean rating in the soak test, it is contemplated that compositions with lesser results are still within the invention. Thus, to be considered within the invention, a composition must give at least about a 50% clean rating in the soak test. Preferably, the soak test results will be about 80% or higher, with the most preferable result being 100% clean, such as is shown in the Examples.

b) Glass and Curtain Cleaning

With compositions of the current invention, results in the curtain test and the glass test should preferably be least equal to that of the commercial products, which in this case is a 1 rating in the glass test, and a 1 or 2 rating in the curtain test. As noted above, the higher the glass test or curtain test rating, the more preferred is the composition.

Comparative Examples -- commercially available shower cleaners

| | Clean Shower ® Blue | Clean Shower ® Yellow | Tilex ® |
|---|---|---|---|
| Comparative Example | 1 | 2 | 3 |
| pH | 4.92 | 5.06 | 11.74 |
| Soak test % clean | 100 | 100 | 100 |
| Curtain test rating | 2 | 1 | 2 |
| Glass test rating | 1 | 1 | 1 |

Clean Shower ® is a registered trademark of Automation, Inc. of Jacksonville, Florida.
Tilex ® is a registered trademark of The Clorox Company, Oakland California.

Examples

| Component[a] | 1 | 2 | 3 | 4 | 5 | 6 | 7 | 8 | 9 | 10 | 11 | 12 |
|---|---|---|---|---|---|---|---|---|---|---|---|---|
| Solvent 1[b] | 4.4 | 4.4 | 4.4 | | | 4.4 | | 4.4 | 4.4 | | 4.4 | 4.4 |
| Solvent 2[c] | | | | 4.4 | 4.4 | | 4.4 | | | 4.4 | | |
| Surfactant A[d] | 5 | 3 | 5 | 3 | 5 | 2 | 1.5 | 1.0 | 1.5 | 1.5 | 1.0 | 1.5 |
| EDTA[e] | | | | | | .44 | .44 | .44 | .44 | 2.2 | .44 | .44 |
| Surfactant B[f] | 1.5 | | | | | | | | | | | |
| Surfactant C[g] | | 1.5 | 1.5 | | | | | | | | | |
| pH | 9.91 | 9.79 | 9.81 | | | 10.69 | 10.71 | 10.81 | 10.73 | 10.71 | 10.81 | 10.73 |
| Soak test % clean | 100 | 100 | 100 | 0 | 0 | 100 | 100 | 100 | 100 | 100 | 100 | 100 |
| Curtain test rating | 1 | 3 | 3 | | | 2 | 2 | 4 | 3 | 5 | 2 | 3 |
| Glass test rating | 1 | 1 | 1 | | | 2 | 2 | 3 | 4 | 4 | 4 | 5 |

[a]In every formula of the examples, water is added to bring the total to 100 parts. Thus, the numbers in the table represent percent by weight of the component in the composition.

[b]butyl Carbitol

[c]isopropanol

[d]Anionic surfactant which is the reaction product of maleic acid, fumaric acid, itaconic acid, or a mixture thereof with a polyol of structure R-$(po)_3$-$(eo)_{14}$-$(po)_{17}$-OH, where R is a $C_6$–$C_{10}$ alkyl group

[e]tetrasodium salt of ethylenediamine tetraacetic acid.

[f]a po/eo/po/eo/po block copolymer, number average molecular weight about 3200, about 34% ethylene oxide. The hydrophile lipophile balance is about 14.

[g]R-$(oxide1)_a$-OH, where R is C10–12 alkyl, a is about 15, and oxide1 has a composition of about 13 ethylene oxide and 2 propylene oxide.

What is claimed is:

1. A hard surface cleaning composition comprising:

(a) a water soluble organic solvent;

(b) an anionic surfactant which comprises the reaction product of maleic acid, fumaric acid, itaconic acid, or a mixture thereof and at least one selected poly (oxyalkylated) polyol or epoxy-capped poly (oxyalkylated) polyol in the presence of a peroxy-type free radical initiator to form a carboxylic group containing addition product, wherein the reaction product is neutralized with a sufficient amount of a neutralizing agent to convert at least a major portion of carboxylic groups in the reaction product to salt groups; and (c) a third component comprising a chelating agent or a nonionic surfactant selected from the group consisting of alcohol alkoxylates, alcohol block alkoxylates, polyoxyethylene polyoxypropylene block surfactants, and mixtures thereof.

2. The composition of claim 1, wherein the water-soluble organic solvent is ethylene glycol monobutyl ether, ethylene glycol monopropyl ether, propylene glycol n-propyl ether, propylene glycol monobutyl ether, dipropylene glycol methyl ether, 2-(2-butoxyethoxy) ethanol and mixtures thereof.

3. The composition of claim 1, wherein the poly (oxyalkylated) polyol is an alcohol-initiated block copolymer of ethylene oxide and propylene oxide.

4. The composition of claim 3, wherein the poly (oxyalkylated) polyol has the structural formula $$R—(po)_x—(eo)_y—(po)_z—OH$$

wherein R is the alkyl residue of an alcohol containing 6 to 18 carbon atoms, po is propylene oxide, eo is ethylene oxide, x is from 1 to 5, y is from 8 to 20, and z is from 5 to 40.

5. The composition of claim 4, wherein x is about 3, y is from 10 to 20, and z is from 8 to 30.

6. The composition of claim 5, wherein x is about 3, y is about 14, z is about 17, and R is an alkyl group having from 6 to 10 carbon atoms.

7. The composition of claim 1, wherein component (c) comprises a chelating agent selected from the group consisting of ethylene diamine tetracetic acid, salts thereof, and mixtures thereof.

8. The composition of claim 1, wherein component (c) comprises a chelating agent selected from the group consisting of methyl glycine diacetic acid, salts thereof, and mixtures thereof.

9. The composition of claim 1, wherein component (c) comprises a nonionic surfactant selected from the group consisting of (a) block alkoxylate of general structure $$R—(oxide1)_a—OR'$$

(b) diblock alkoxylate of general structure $$R—(oxide1)_a—(oxide2)_b—OR'$$

(c) triblock alcohol alkoxylate of general structure $$R—(oxide1)_a—(oxide2)_b—(oxide3)_c—OR'$$

and mixtures thereof, wherein R is an alkyl or aralkyl group containing 6 to 24 carbon atoms; a, b, and c are each from about 1 to about 35; R' is hydrogen, an alkyl group with 1 to 18 carbon atoms, a hydroxyalkyl group, or a mixture thereof; and where oxidel, oxide2, and oxide3 each represent at least one alkylene oxide selected from the group consisting of ethylene oxide, propylene oxide, butylene oxide, and mixtures thereof, with the proviso that the relative alkylene oxide composition of oxide2 differs from that of oxide1 and oxide3.

10. The composition of claim 1, wherein component (c) is a nonionic surfactant selected from the group consisting of a polyoxyethylene polyoxypropylene block surfactant of general structure $$R—(eo)_a—(po)_b—(eo)_c—R'$$

a polyoxyethylene polyoxypropylene block surfactant of general structure $$R—(po)_a—(eo)_b—(po)_c—(eo)_d—(po)_e—R'$$

and mixtures thereof, wherein a, b, c, d, and e each represent the number of ethylene oxide or propylene oxide units in each of the blocks; R and R' are independently H, $C_{1-18}$ alkyl, hydroxyalkyl, or mixtures thereof; and the number average molecular weight of the surfactant is from about 1800 to about 6000.

11. The composition of claim 9 where the nonionic surfactant has the general structure $$R—(oxide1)_a—OH$$

wherein R is an alkyl group containing 6 to 18 carbon atoms, a is from 3 to 30, and oxidel is selected from the group consisting of ethylene oxide, propylene oxide, butylene oxide, and mixtures thereof.

12. The composition of claim 11, wherein oxidel is a mixture of ethylene oxide and propylene oxide, wherein oxidel is more than 50 mole percent ethylene oxide.

13. The composition of 12, wherein oxidel is more than 70 mole percent ethylene oxide.

14. The composition of claim 1, further comprising water.

15. The composition of claim 1 where component (c) is a chelating agent, wherein:

(a) is present at a level of from 0.1–10 parts by weight of the composition;

(b) is present at a level of from 0.5–10 parts by weight of the composition; and (c) is present at a level of from 0.2–10 parts by weight of the composition.

16. The composition of claim 1 where component (c) is a nonionic surfactant, wherein:

(a) is present at a level of from 0.1 to 10 parts by weight of the composition;

(b) is present at a level of from 2.0 to 10 parts by weight of the composition; and (c) is present at a level of from 0.2 to 10 parts by weight of the composition.

17. A hard surface cleaning composition comprising:

(a) water soluble organic solvent;

(b) an anionic surfactant which comprises the reaction product of maleic acid, fumaric acid, itaconic acid, or a mixture thereof and at least one poly(oxyalkylated) polyol or epoxy-capped poly(oxyalkylated) polyol in the presence of a peroxy-type free radical initiator to form a carboxylic group containing addition product, wherein the reaction product is neutralized with a sufficient amount of a neutralizing agent to convert at least a major portion of carboxylic groups in the reaction product to salt groups; and (c) a chelating agent.

18. A hard surface cleaning composition comprising:

(a) water soluble organic solvent;

(b) an anionic surfactant which comprises the reaction product of maleic acid, fumaric acid, itaconic acid, or a mixture thereof and at least one poly(oxyalkylated) polyol or epoxy-capped poly(oxyalkylated) polyol in the presence of a peroxy-type free radical initiator to form a carboxylic group containing addition product, wherein the reaction product is neutralized with a sufficient amount of a neutralizing agent to convert at least a major portion of carboxylic groups in the reaction product to salt groups; and (c) a nonionic surfactant selected from the group consisting of alcohol alkoxylates, alcohol block alkoxylates, polyoxyethylene polyoxypropylene block surfactants, and mixtures thereof.

* * * * *